United States Patent [19]

Dods

[11] Patent Number: 4,905,828

[45] Date of Patent: Mar. 6, 1990

[54] PACKAGE FOR TRADING CARD AND MODEL VEHICLE

[75] Inventor: Robert E. Dods, Glen Ellyn, Ill.

[73] Assignee: Racing Champions, Inc., Glen Ellyn, Ill.

[21] Appl. No.: 388,851

[22] Filed: Aug. 3, 1989

[51] Int. Cl.[4] ..... B65D 85/68

[52] U.S. Cl. ..... 206/335; 206/45.19; 206/45.34; 206/461; 446/75

[58] Field of Search ..... 206/45.19, 45.34, 335, 206/461, 462, 467, 471, 232; 446/75, 396, 431; 40/124

[56] References Cited

U.S. PATENT DOCUMENTS

| | | | |
|---|---|---|---|
| 2,884,127 | 4/1959 | Neary | 206/462 |
| 3,249,217 | 5/1966 | Irving | 206/461 |
| 3,533,503 | 10/1970 | Wood | 206/45.34 |
| 3,811,565 | 5/1974 | Trancredi | 206/45.34 |
| 3,847,276 | 11/1974 | Lehner et al. | 206/45.34 |
| 3,935,944 | 2/1976 | Wilson et al. | 206/232 |
| 4,185,739 | 1/1980 | Wilford | 206/335 |
| 4,391,367 | 7/1983 | Perego | 206/335 |
| 4,445,611 | 5/1984 | Shofu | 206/45.34 |
| 4,669,610 | 6/1987 | Lindsey et al. | 206/461 |
| 4,749,082 | 6/1988 | Gardiner et al. | 206/461 |
| 4,804,984 | 2/1989 | Heuer et al. | 206/461 |
| 4,840,275 | 6/1989 | Faiola et al. | 206/462 |

FOREIGN PATENT DOCUMENTS

| | | | |
|---|---|---|---|
| 1350847 | 12/1962 | France | 206/45.34 |

*Primary Examiner*—David T. Fidei

*Attorney, Agent, or Firm*—Edmond T. Patnaude

[57] ABSTRACT

The present invention relates in general to the packaging of minature model vehicles and trading cards relating thereto, and it relates more particularly to a novel combination of a trading card including a picture of the vehicle, a picture of the driver represented by the model and information relating to the driver, a display stand for the vehicle and the associated card, and a model vehicle, all of which are carried by a single display and packaging card.

6 Claims, 2 Drawing Sheets

PACKAGE FOR TRADING CARD AND MODEL VEHICLE

The present invention relates in general to the packaging of minature model vehicles and trading cards relating thereto, and it relates more particularly to a novel combination of a trading card including a picture of the vehicle, a picture of the driver represented by the model and information relating to the driver, a display stand for the vehicle and the associated card, and a model vehicle, all of which are carried by a single display and packaging card.

BACKGROUND OF THE INVENTION

Trading cards bearing a picture of an athlete and information relating to such person and his or her accomplishments have been marketed and collected for many years. Similarly, miniature replicas of automobiles and other things and people have been marketed as collectibles.

SUMMARY OF THE INVENTION

Briefly, there is provided in accordance with the present invention a new and improved method of packaging trading cards and corresponding miniature replicas of automotive vehicles, and there is also provided a new and improved package for a trading card and a corresponding miniature replica of an automotive vehicle. In a preferred embodiment of the invention a trading card is incorporated into a blister pack type of mounting card as an integral part thereof, and a miniature vehicle is attached to the card by a transparent plastic blister affixed to the card over the vehicle. A display stand on which the vehicle is mounted is also enclosed within the blister and positioned against the card so as to be viewed simultaneously with the trading card and the vehicle. Interfitting, complementary portions of the vehicle and of the display stand hold the vehicle in the desired position on the display stand while within the blister and after subsequent removal from the package.

The display stand also includes means for retaining the trading card in a position above and behind the miniature vehicle mounted on the display stand.

In the preferred embodiment of the invention, the vehicle is a miniature replica of a race car, and the trading card carries a picture of the race car, its usual driver and statistical information relating to the driver and to the car. Being an integral part of the blister card the trading card can be printed simultaneously with the blister card to reduce the manufacturing cost thereof. The trading card is readily removable from the blister card for mounting on the display stand after removal of the trading card and the display stand from the package.

GENERAL DESCRIPTION OF THE DRAWING

Further objects and advantages and a better understanding of the present invention will be had by reference to the following detailed description taken in connection with the accompanying drawing wherein.

DETAILED DESCRIPTION OF A PREFERRED EMBODIMENT

Figure 1:
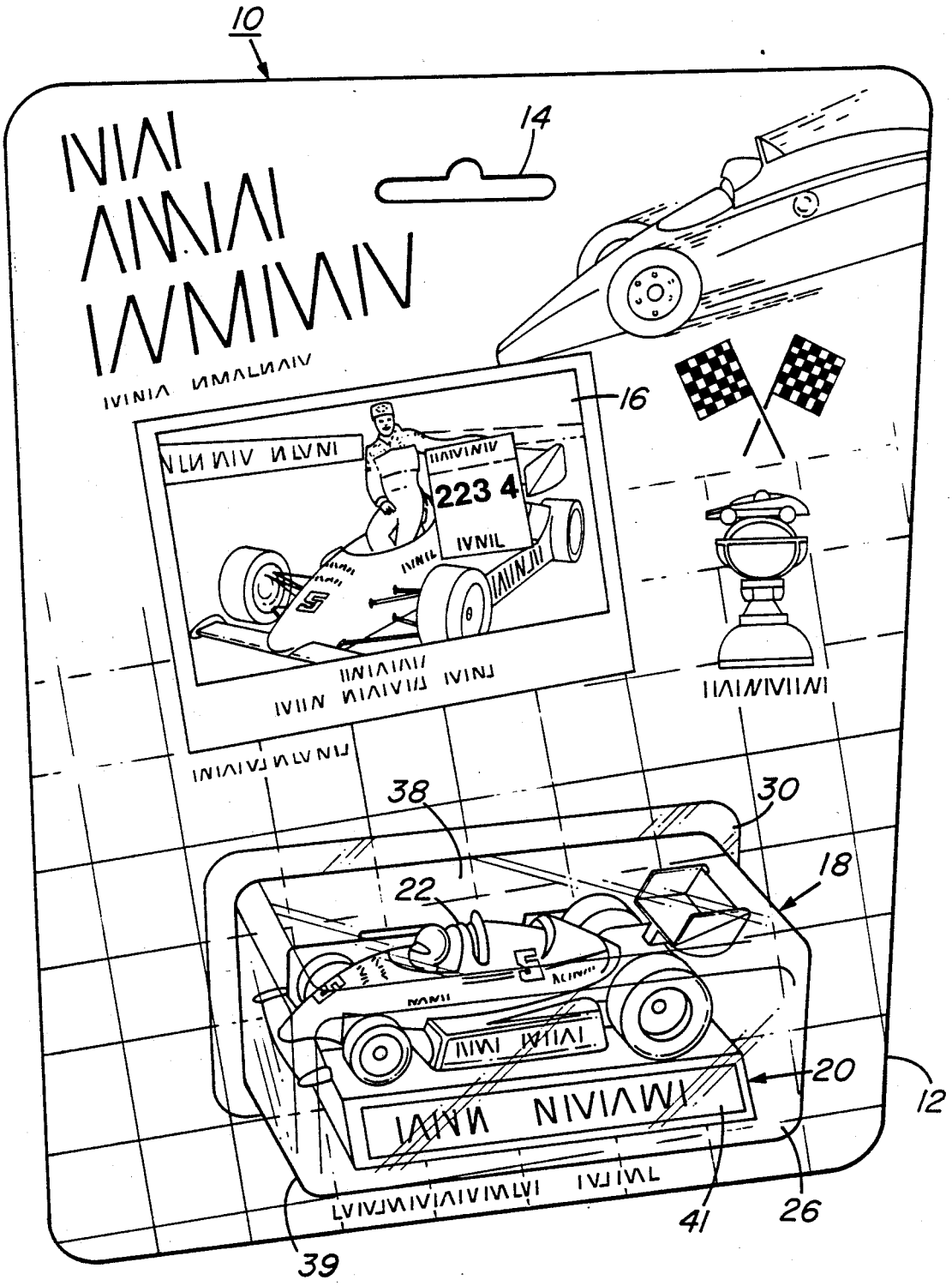
FIG. 1 is an isometric view of the front side of a package embodying the present invention, the package including a miniature replica of an automotive vehicle, a display stand on which the vehicle is disposed, and a trading card containing information relating to the vehicle and its usual driver.

Referring particularly to FIG. 1, a package 10 may be seen to include a relatively rigid paper board sheet 12 of the type known in the art as a blister card. A slot 14 is provided in the card 12 near the top thereof to enable the card to be hung on a hook or the like. Suitable advertising and descriptive information may be printed on the face of the card as illustrated in the drawing.

In accordance with one feature of the invention a trading card 16 is incorporated into the blister card 12 as a unitary part thereof. A line 17 surrounding the trading card 16 is printed on the blister card 12 to facilitate removal of the trading card 16 from the blister card 12 by means of a scissors or the like. Although not visible in the drawings it will be understood that information is printed on both the front and rear sides of the trading card 16.

Figure 4:
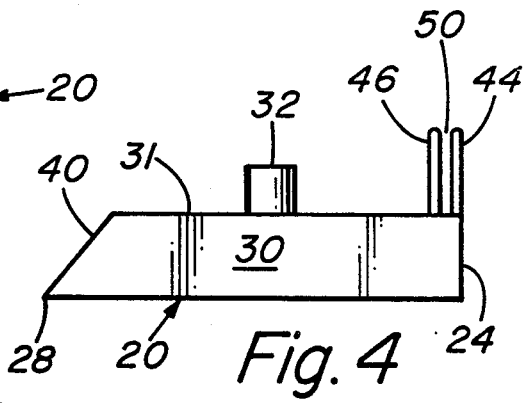
FIG. 4 is an elevational view taken from the right hand side of FIG. 3.

A preformed transparent plastic blister 18 having parallel top and bottom walls and parallel side walls is affixed to the blister card 12 below the trading card 16 and encloses a display stand 20 on which a miniature replica of a race car 22 is mounted. As best shown in FIG. 4, the display stand 20 includes a planar rear wall 24 which abuts the front face of the blister card 12 in the package 10 shown in FIG. 1. The transparent blister 18 has a planar front wall 26 which abuts the front edge 28 of the display stand 20 when the rear flange 30 is positioned against the front face of the blister card 12 as shown in FIG. 1. In this manner the display stand is maintained in a fixed position with the package 10.

The display stand includes a base section 30 having a platform surface 31 on the top from which an upstanding cylindrical lug 32 extends. The vehicle 22 is disposed on the display stand 20 with the wheels 34 of the vehicle resting on the platform surface 31. The lug 32 extends upwardly into a shallow cylindrical recess 36 provided in the bottom of the vehicle 22. The recess 36 is complementary to the lug 32 to prevent relative horizontal movement between the vehicle 22 and the display stand 20. While the vehicle 22 and the display stand 20 are in the package 10, the top wall 38 of the transparent blister 18 engages the top of the vehicle 22 and the bottom wall 39 engages the bottom of the display stand to prevent relative vertical movement between the vehicle 22 and the platform 31.

Figure 2:
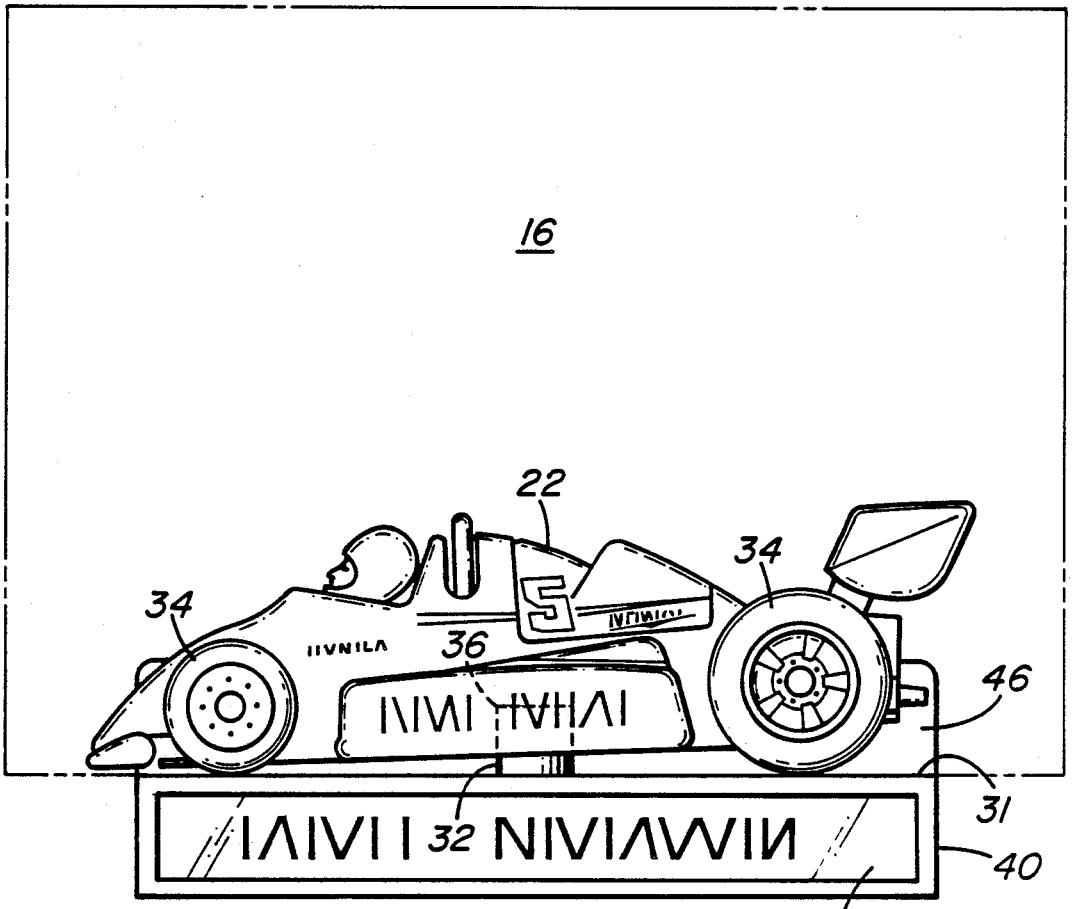
FIG. 2 is a front elevational view of the display stand, the miniature vehicle and the trading card of FIG. 1.
Figure 3:
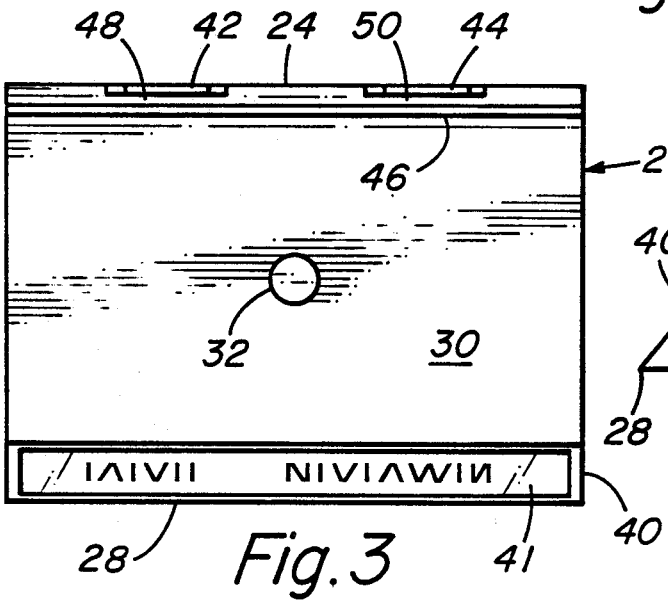
FIG. 3 is a plan view of the display stand.

The display stand 20 has a rearwardly canted front wall 40 which carries a sign or the like 41 identifying the unstressed 22. Extending upwardly from the platform surface 31 at the rear thereof are a pair of planar integral tabs 42 and 44 which rear surfaces are coplanar with the rear wall of the platform. An upstanding planar member 46 extends upwardly from the surface 31 a short distance forwardly of the tabs 42 and 44 to define a pair of aligned slots 48 and 50 for receiving the bottom portion of the trading card 16 as shown in FIG. 2. The slots 48 and 50 each have a width when the tabs 42 and 44 are in the unstressed state which is slightly less than the thickness of the trading card. Therefore, when the card is pushed down into the slots 48 and 50 and the tabs 42 and 44 firmly grip the card 16 to hold it in place on the display stand 30.

It will thus be seen that the present invention provides a novel package for a trading card, an associated model vehicle, and a display stand for the vehicle and the trading card. Removal of the trading card and the model vehicle and display stand is not readily accomplished in a surreptitious manner whereby theft of the trading card and vehicle is deterred by the package. However, once purchased, the blister can be torn away from the blister card and the vehicle and the associated display stand can be easily removed. Moreover, after the blister 18 has been removed from the blister card 12 the trading card can then be cut out of the blister card by means of scissors or the like.

While the present invention has been described in connection with a particular embodiment thereof, it will be understood by those skilled in the art that many changes may be made without departing from the true spirit and scope of the present invention. Therefore, it is intended by the appended claims to cover all such changes and modifications which come within the true spirit and scope of this invention.

What is claimed:

1. In combination, a model vehicle, a trading card having information printed thereon relating to a driver of said vehicle, a display stand having a platform for removably supporting said vehicle, said stand having means for holding said card in an upright position adjacent said platform, a package including a relatively rigid sheet to which said trading card is attached, said model vehicle and said display stand being disposed against said sheet, and transparent means attached to said sheet over said model vehicle for holding said model vehicle on said sheet.

2. The combination according to claim 1 wherein said display stand is disposed against said sheet, and said transparent means overlies said display stand for holding said stand on said sheet.

3. The combination according to claim 2, wherein said vehicle is positioned on said display stand between said sheet and said transparent means.

4. The combination according to claim 2, wherein said model vehicle is provided with a bottom portion having a recess therein, and said display stand is provided with an upstanding lug extending into said recess.

5. The combination according to claim 4, said lug being complementary to the shape of said recess.

6. The combination according to claim 1, said trading card being a removable portion of said sheet.

* * * * *